US006040255A

United States Patent [19]

Hudson

[11] Patent Number: 6,040,255

[45] **Date of Patent: *Mar. 21, 2000**

[54] PHOTOSTABILIZATION PACKAGE USABLE IN NONWOVEN FABRICS AND NONWOVEN FABRICS CONTAINING SAME

[75] Inventor: Robert Leslie Hudson, Roswell, Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,606

[22] Filed: Jun. 25, 1996

[51] Int. Cl.[7] ..... D04H 3/00

[52] U.S. Cl. ..... 442/382; 442/392; 442/400; 442/401; 442/414

[58] Field of Search ..... 442/414, 382, 442/392, 400, 401

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 4,041,203 | 8/1977 | Brock et al. | 428/157 |
| 4,100,324 | 7/1978 | Anderson et al. | 428/288 |
| 4,115,414 | 9/1978 | Piltingsrud | 106/288 |
| 4,340,563 | 7/1982 | Appel et al. | 264/518 |
| 4,374,888 | 2/1983 | Bornslaeger . | |
| 4,795,668 | 1/1989 | Krueger et al. | 428/174 |
| 4,818,464 | 4/1989 | Lau | 264/510 |
| 4,937,063 | 6/1990 | Sullivan | 423/593 |
| 5,057,368 | 10/1991 | Largman et al. | 428/397 |
| 5,069,970 | 12/1991 | Largman et al. | 428/373 |
| 5,108,820 | 4/1992 | Kaneko et al. | 428/198 |
| 5,108,827 | 4/1992 | Gessner | 428/219 |
| 5,145,727 | 9/1992 | Potts et al. | 428/198 |
| 5,169,706 | 12/1992 | Collier, IV et al. | 428/152 |
| 5,178,931 | 1/1993 | Perkins et al. | 428/198 |
| 5,186,748 | 2/1993 | Erkens et al. | 106/479 |
| 5,188,885 | 2/1993 | Timmons et al. | 428/198 |
| 5,200,443 | 4/1993 | Hudson | 524/99 |
| 5,203,917 | 4/1993 | Schwochow | 106/479 |
| 5,277,976 | 1/1994 | Hogle et al. | 428/397 |
| 5,294,482 | 3/1994 | Gessner | 428/287 |
| 5,336,552 | 8/1994 | Strack et al. | 428/224 |
| 5,382,400 | 1/1995 | Pike et al. | 264/168 |
| 5,399,335 | 3/1995 | Sullivan | 423/593 |
| 5,411,586 | 5/1995 | Schmid et al. | 106/415 |
| 5,466,410 | 11/1995 | Hills | 264/172.11 |

FOREIGN PATENT DOCUMENTS

| | | | |
|---|---|---|---|
| 0443981A1 | 8/1991 | European Pat. Off. | C01G 31/00 |
| 0704560 | 4/1996 | European Pat. Off. . | |
| 3315851 | 10/1984 | Germany | C09C 1/00 |
| 4119668 | 12/1992 | Germany | C01G 31/00 |

OTHER PUBLICATIONS

Manson, et al; Polymer Blends and Composites; 1976 pp. 273–277.

*Primary Examiner*—Elizabeth M. Cole

*Attorney, Agent, or Firm*—William D. Herrick; James B. Robinson

[57] ABSTRACT

A stabilizing additive package for nonwoven fabrics is provided. The package has a bismuth vanadate based pigment and a hindered amine light stabilizer. The bismuth vanadate is added to a nonwoven fiber polymer prior to extrusion in an amount between about 0.1 and 3 weight percent based on the weight of the fabric and the hindered amine in an amount between about 0.25 and 2.5 weight percent based on the weight of the fabric. The nonwoven fabric also provided by this invention may be used as protective covers for, for example, boats and cars, and as an outdoor fabric for, for example, canopies and tents.

13 Claims, 2 Drawing Sheets

PHOTOSTABILIZATION PACKAGE USABLE IN NONWOVEN FABRICS AND NONWOVEN FABRICS CONTAINING SAME

BACKGROUND OF THE INVENTION

Nonwoven fabrics are used for a wide variety of applications from baby wipes and diapers to automobile covers and geotextiles. These applications call for materials having diverse properties and attributes. Some applications, for example, call for nonwovens which are highly wettable, i.e. quickly allow liquids to pass through them, e.g. diapers and feminine hygiene products and which are generally designed for short term use and disposability. Others require a high degree of repellence and photostability, e.g. outdoor fabrics like car covers, awnings and canopies for much longer term usage.

Since most nonwovens are made of polymers containing chromophores, they tend to be relatively reactive when exposed for long periods of time to sources of energy such as sunlight. This reactivity and subsequent oxidation of the fabric results in a serious deterioration of the tensile strength of the fabric. Therefore, one of the most difficult problems facing designers of nonwoven fabrics for outdoor use has been improving the retention of tensile strength upon exposure to sunlight, i.e.; the photostability of the fabric. A compounding difficulty has been that it is usually desired to color or pigment nonwoven fabrics for outdoor use as the original polymer color tends to be rather dull, and it has been found that most currently known pigments have a negative effect on the photostability of nonwoven fabrics. Further complicating the issue, many pigments contain colorants or other ingredients which are toxic and therefore not permitted. As a result, there is a small class of pigments useable in nonwoven fabric and they have a negative effect on the fabric life because of the deterioration of tensile strength they cause.

It is an object of this invention to provide a stabilization additive package for nonwoven webs which includes a pigment and which greatly improves the retention of tensile properties of the nonwoven web upon exposure to sunlight.

It is a further object of this invention to provide a nonwoven fabric having such a stabilization additive package.

SUMMARY

The objects of the invention are provided by an additive package containing hindered amine light stabilizers or HALs and a bismuth vanadate based pigment. The HAL may be present in an amount between about 0.25 and 2.5 weight percent and the bismuth vanadate based pigment in an amount between about 0.1 and 3 weight percent of the nonwoven fabric.

DEFINITIONS

Figure 1:
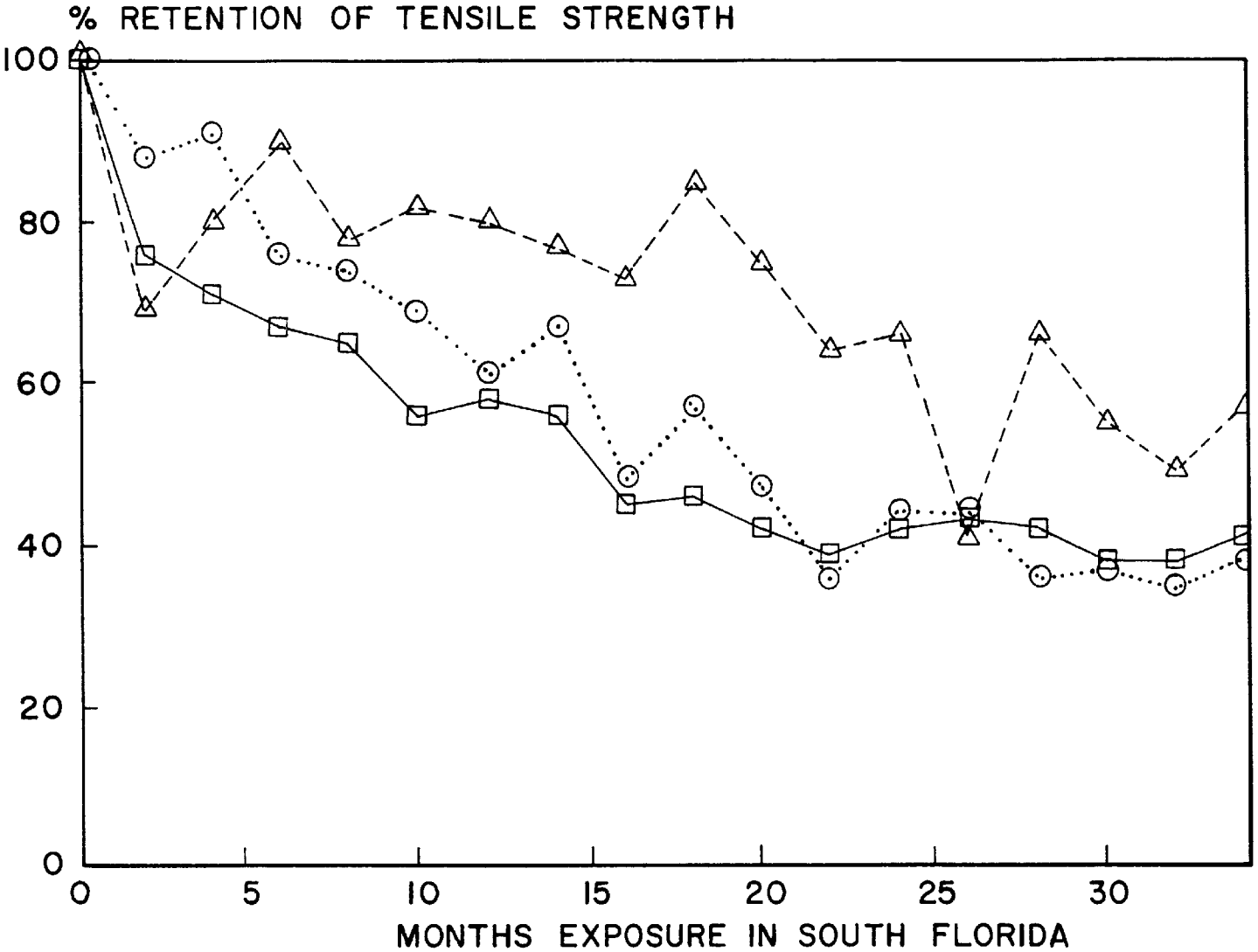
FIG. 1 is a graph of percent retention of tensile strength (y axis) versus months of exposure to sunlight in south Florida (x axis) for fabrics made with additives as described in Examples 1, 2 and 3. The data for this Figure are given in Table 1.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein "multilayer laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (3 to 400 gsm), or more particularly from about 0.75 to about 3 osy. Multilayer laminates may also have various numbers of meltblown layers or multiple spunbond layers in many different configurations and may include other materials like films (F) or coform materials, e.g. SMMS, SM, SFS, etc.

As used herein, the term "coform" means a process in which at least one meltblown diehead is arranged around a chute through which other materials are added to the web while it is forming. Such other materials may be pulp, superabsorbent particles, cellulose or staple fibers, for example. Coform processes are shown in commonly assigned U.S. Pat. No. 4,818,464 to Lau and U.S. Pat. No. 4,100,324 to Anderson et al. Webs produced by the coform process are generally referred to as coform materials.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "machine direction" or MD means the length of a fabric in the direction in which it is produced. The term "cross machine direction" or CD means the width of fabric, i.e. a direction generally perpendicular to the MD.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement, a pie arrangement or an "islands-in-the-sea" arrangement. Conjugate fibers are taught in U.S. Pat. No. 5,108,820 to Kaneko et al., U.S. Pat. No. 4,795,668 to Krueger et al. and U.S. Pat. No. 5,336,552 to Strack et al. Conjugate fibers are also taught in U.S. Pat. No. 5,382,400 to Pike et al. and may be used to produce crimp in the fibers by using the differential rates of expansion and contraction of the two (or more) polymers. Crimped fibers may also be produced by mechanical means and by the process of German Patent DT 25 13 251 A1. For two component fibers, the polymers may be present in ratios of 75/25, 50/50, 25/75 or any other desired ratios. The fibers may also have shapes such as those described in U.S. Pat. No. 5,277,976 to Hogle et al., U.S. Pat. No. 5,466,410 to Hills and U.S. Pat. No. 5,069,970 and U.S. Pat. No. 5,057,368 to Largman et al., which describe fibers with unconventional shapes.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. Nos. 5,108,827 and 5,294,482 to Gessner. Bicomponent and biconstituent fibers are also discussed in the textbook Polymer Blends and Composites by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn fumiture, as well as floor coverings, table cloths and picnic area covers.

As used herein, the term "outdoor fabric" means a fabric which is primarily, though not exclusively, used outdoors. Outdoor fabric includes fabric used in protective covers, camper/trailer fabric, tarpaulins, awnings, canopies, tents, agricultural fabrics and outdoor apparel such as head coverings, industrial workwear and coveralls, pants, shirts, jackets, gloves, socks, shoe coverings, and the like.

TEST METHODS

Grab Tensile test: The grab tensile test is a measure of breaking strength and elongation or strain of a fabric when subjected to unidirectional stress. This test is known in the art and conforms to the specifications of Method 5100 of the Federal Test Methods Standard 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for grab tensile strength and grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model TM, available from the Instron Corporation, 2500 Washington St., Canton, Mass. 02021, or a Thwing-Albert Model INTELLECT II available from the Thwing-Albert Instrument Co., 10960 Dutton Rd., Phila., Pa. 19154, which have 3 inch (76 mm) long parallel clamps. This closely simulates fabric stress conditions in actual use.

Melt Flow Rate: The melt flow rate (MFR) is a measure of the viscosity of a polymer. The MFR is expressed as the weight of material which flows from a capillary of known dimensions under a specified load or shear rate for a measured period of time and is measured in grams/10 minutes at a set temperature and load according to, for example, ASTM test 1238-90b.

South Florida test: This test is conducted by exposing the fabric to the sun without a backing in Miami, Fla. The samples face south at a 45 degree angle. Each cycle concludes with a modified tensile test in pounds to measure the degradation or change in strength of the fabric. This provides a measure of the durability of the fabric.

DETAILED DESCRIPTION OF THE INVENTION

The field of nonwoven fabrics is a diverse one encompassing absorbent products such as diapers, wipes and feminine hygiene products and barrier products such as surgical gowns and drapes, and bandages. Nonwovens are also used for more durable applications such as protective covers and outdoor fabrics where resistance to the elements and photostability are important features.

A problem for protective covers, outdoor fabrics and other nonwovens exposed to a great deal of sunlight has been the retention of tensile properties over time or photostability. The inventors have developed a novel stabilization additive package which can improve the photostability of nonwoven fabrics greatly. This invention also includes a nonwoven fabric having the stabilization additive package of the invention.

The fibers from which the fabric of this invention is made may be produced by the meltblowing or spunbonding processes which are well known in the art. These processes generally use an extruder to supply melted thermoplastic polymer to a spinneret where the polymer is fiberized. The fibers are then drawn, usually pneumatically, and deposited on a foraminous mat or belt to form the nonwoven fabric. The fibers produced in the spunbond and meltblown processes are microfibers as defined above.

The fibers used may also contain coform materials and further may be conjugate and biconstituent fibers as defined above. In this case the stabilization additive package may be added to any of the polymers used as long as the stabilization additive package is in a layer exposed to sunlight. For example, in the case of sheath/core conjugate fibers, the stabilization additive package should be mixed with the polymer of the sheath.

The fabric of this invention may also be a multilayer laminate. In this case, the stabilization additive package should be mixed with the polymer used in the outermost layers of the fabric. The stabilization additive package may also be mixed with the polymer(s) of the inner layer(s) but one would expect less of an effect on tensile in these layers since they are not exposed to sunlight as much as the outer layers.

Basis weights for car covers are generally between about 2 osy (68 gsm) and 7.2 osy (244 gsm). In a typical nonwoven fabric laminate car cover, the outer, usually spunbond layers may have a basis weight between 0.5 osy (17 gsm) and 3.5 osy (119 gsm) and may have one or more inner layer having a basis weight between about 0.2 osy (7 gsm) and 1.5 osy (51 gsm).

It is also possible, when the fabric of this invention is used as a multilayer car cover, to skew the basis weights of the outer layers where the outer layer closest to the car is of a lower basis weight than the other outer layer, or more particularly, where the layer closest to the car has a basis weight ranging from about 40 to 75% of the basis weight of the layer farthest from the car. It is believed that skewing the basis weights to make the heavier basis weight layer away from the car, and therefore exposed to the sunlight, increases the long term tensile strength simply by putting more material in the layer most vulnerable to deterioration. It has also been found advantageous to use a lower denier fabric for the layer closet to the car as compared to the layer farthest from the car. The reason for this appears to be that a finer layer against the car reduces abrasion caused by wind and by the acts of covering and uncovering the car and therefore produces less loss in glossiness of the car paint after prolonged usage, as compared to a thicker fiber layer against the car. An example of the ranges of the basis weights of the layers of such a fabric are 68 to 105 gsm for the layer away from the surface of the car, 10 to 25 gsm for the inner layers of the laminate and 27 to 60 gsm for the layer against the car. Still more particularly, a car cover having, for example, an overall basis weight of 163 gsm (4.8 osy), may have four layers with basis weights as follows, starting with the layer against the car: 44 gsm, 17 gsm, 17 gsm, 85 gsm (1.3 osy, 0.5 osy, 0.5 osy, 2.5 osy) wherein the outer layers would be spunbond and the inner layers meltblown.

Multilayer fabrics are bonded in some manner as they are produced in order to give them structural integrity and make them into a finished product. Bonding can be accomplished in a number of ways known in the art such as hydroentanglement, needling, ultrasonic bonding, adhesive bonding and thermal bonding.

The thermoplastic polymers which may be used in the practice of this invention may be any known to those skilled in the art to be commonly used in meltblowing and spunbonding. Such polymers include polyolefins, polyesters and polyamides, and mixtures thereof, more particularly polyolefins such as polyethylene, polypropylene, polybutene, ethylene copolymers, propylene copolymers and butene copolymers and mixtures thereof.

The spunbond layers of the fabric of this invention are preferably polyolefin, more particularly polypropylene having a melt flow rate (MFR) of between 9 and 1000, and still more particularly between 9 and 100. The MFR is an indication of the viscosity of the polymer with a higher number indicating a lower viscosity. It should be noted that in multilayer fabrics the layers need not be spun from the same polymer. Suitable polypropylenes for the spunbond layers are commercially available as, for example, PF-301 and PF-305 from the Himont Corporation of Wilmington, Del.

In a multilayer fabric or laminate having meltblown layers, they are also preferably polyolefin, particularly polypropylene, and like the spunbond layers, need not be made from the same polymer. A polypropylene having an MFR of between 200 and 2000 would be suitable. Particularly suitable polypropylenes are PF-015 available from Himont or E5A75 from the Shell Chemical Company of Houston, Tex.

The stabilizer additive package of this invention is an internal additive, as differentiated from a topically applied additive, and is mixed with the polymer prior to polymer extrusion. The package includes hindered amines and a bismuth vanadate based pigment.

Hindered amines are discussed in U.S. Pat. No. 5,200,443 to Hudson and examples of such amines are Hostavin TMN 20 from Hoechst Celanese Corporation of Somerville, N.J., Cyasorb UV-3668 from Cytec Industries, Inc., of West Patterson, N.J. and Uvasil-299 from Great Lakes Chemical Corporation of West Lafayette, Ind. A particularly well suited hindered amine is that commercially available as Chimassorb® 944 FL from the Ciba-Geigy Corporation of Hawthorne, N.Y., and having CAS registry number 70624-18-9. It has been found that to be effective, the hindered amine should have a molecular weight between about 500 and 3500.

The hindered amine light stabilizing material may be added to polymers at an amount of between about 0.25 and 2.5 weight percent. In, for example, spunbond fabrics the amount should be between about 0.5 and 2.5 weight percent and between about 0.25 and 2 weight percent in meltblown. More particularly, the hindered amine may be present in an amount of between about 1 and 1.5 weight percent in spunbond fabrics and about 1 weight percent in meltblown fabrics.

The bismuth vanadate based pigment may be added to polymers at an amount of between about 0.1 and 3 weight percent. In spunbond fabrics, for example, the amount should be between about 0.1 and 2.0 weight percent and between about 0.3 and 3.0 weight percent in meltblown. More particularly, the bismuth vanadate may be present in an amount of between about 0.75 and 2.0 weight percent in spunbond fabrics and at about 1.0 weight percent in meltblown fabrics. Bismuth vanadate based pigments are available commercially from the Ciba-Geigy Corporation of Hawthorne, N.Y., under the tradename IRGACOLOR YELLOW 2GTM.

Bismuth vanadate is known in the art to improve colorfastness, i.e. reduce fading, improve heat resistance, weatherability and freedom from migration, i.e. bleeding. The inventor is unaware of any teaching of reduced deterioration of tensile strength in nonwoven fabrics upon exposure to sunlight due to bismuth vanadate in conjunction with hindered amine light stabilizers.

Bismuth vanadate pigments may be made, for example, in accordance with U.S. Pat. Nos. 4,937,063 and 5,399,335 to Sullivan and assigned to Ciba-Geigy and any other effective method known in the art. The '063 patent describes calcining the starting materials, then wet milling them and treating them with an alkali. The '335 patent describes making a 10–50 weight percent mixture of a solid bismuth compound and a solid vanadate compound at a molar ratio of Bi:V of 1:1–1:0.8 with 90–50 weight percent of a mineral acid solution at a pH of 1, wet grinding the suspension at 0–100° C. until the bismuth and vanadate are transformed into yellow pigmentary bismuth vanadate and then isolating the bismuth vanadate from the mineral acid.

The Chimassorb® 944 FL amine and bismuth vanadate may be incorporated into polypropylene pellets by the Standridge Color Corporation of Social Circle, Ga. Two such commercially available products are sold under the designation SCC-11354, which has 25 weight percent bismuth vanadate pigment weight and SCC-8784 which has 15 weight percent HALs.

The fabric of this invention may also have topical treatments applied to it for more specialized functions. Such topical treatments and their methods of application are known in the art and include, for example, anti-static treatments and the like, applied by spraying, dipping, etc.

It has been found that a fabric having HALs and a bismuth vanadate based pigment has photostability of enhanced durability long sought in outdoor fabrics of this type. The increased longevity of the fabric of this invention provides a cost savings for consumers.

The above mentioned characteristics of the fabric of this invention are illustrated by the examples below, results of the testing of which are given in Table 1. Note that Example 3 is an example of the package and fabric of this invention and the others are not. Note also that the pigment weight percentages represent the pure pigment amount present in the mixture in Examples 2, 3 and 5–9, and the amine weight percentages represent the pure amine amount in the mixture in all Examples.

EXAMPLE 1

A spunbond fabric was produced from Himont's PF-304 polypropylene. Prior to extrusion, 1.0 weight percent of Chimassorb® 944 FL amine was added to and thoroughly mixed with the polymer. No pigment was added to the polymer of this Example. The fabric produced had a basis weight of about 2 osy (69 gsm). The fabric was subjected to the South Florida test described above and periodically tested for tensile strength. The data from this testing is in Table 1 and graphically illustrated in FIG. 1 where the data of this Example is divided by the initial tensile strength to arrive at a percent retention of original tensile strength and which is depicted by circles.

EXAMPLE 2

A spunbond fabric was produced from Himont's PF-304 polypropylene. Prior to extrusion, 1.0 weight percent of a calcined metal oxide and 1.0 weight percent of Chimassord® 944 FL amine was added to and thoroughly mixed with the polymer. The calcined metal oxide was designated V-9119 from the Ferro Chemical Company of Bedford, Ohio and consisted of zinc and iron oxides. The fabric produced had a basis weight of about 2 osy. The fabric was subjected to the South Florida test described above and periodically tested for tensile strength. The data from this testing are in Table 1 and graphically illustrated in FIG. 1 where the data of this Example are divided by the initial tensile strength to arrive at a percent retention of original tensile strength and which is depicted by squares.

EXAMPLE 3

Figure 2:
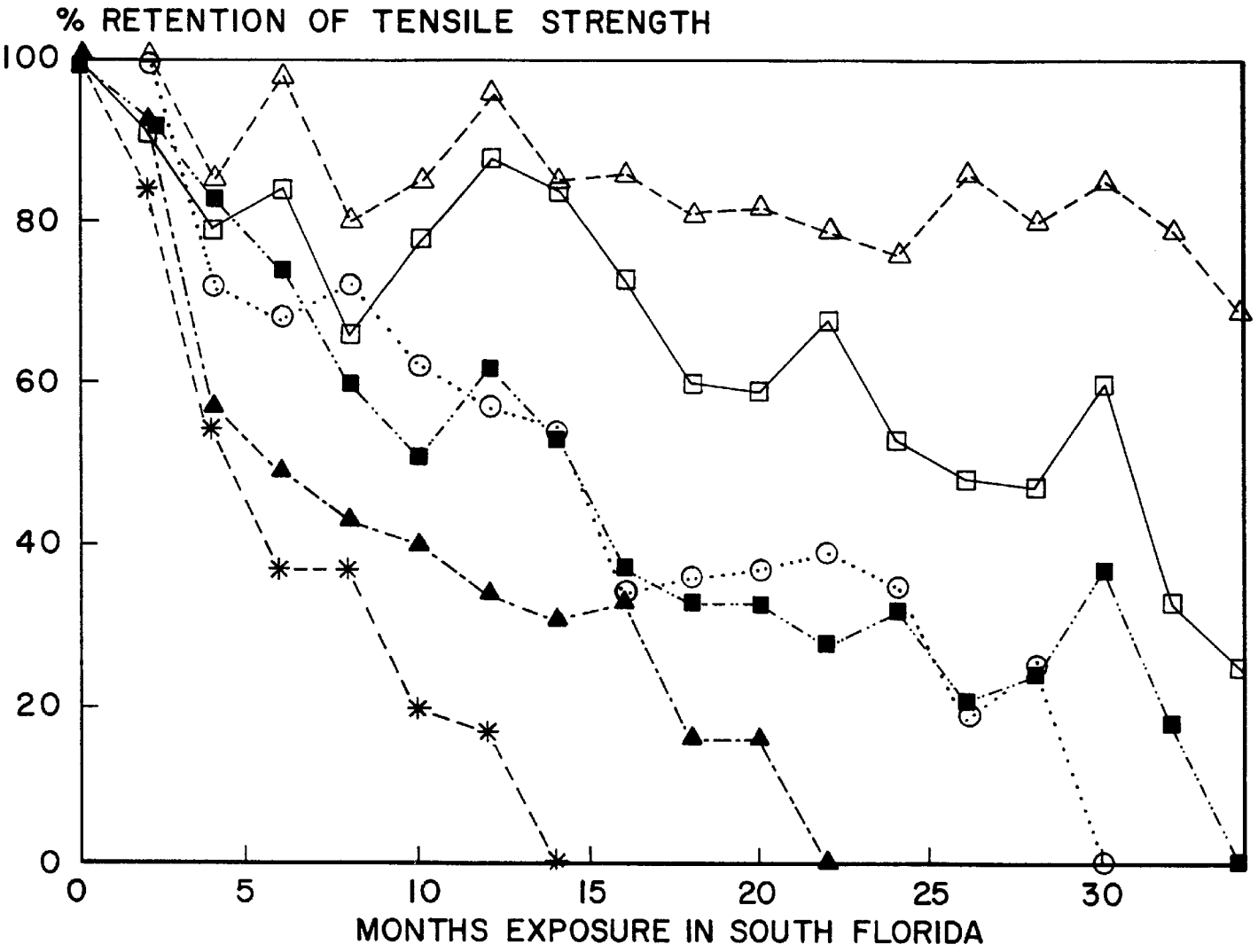
FIG. 2 is a graph of percent retention of tensile strength (y axis) versus months of exposure to sunlight in south Florida (x axis) for fabrics made with additives as described in Examples 4 through 9. The data for this Figure are given in Table 1.

A spunbond fabric was produced from Himont's PF-304 polypropylene. Prior to extrusion, about 0.5 weight percent bismuth vanadate pigment and about 1 weight percent Chimassord® 944 FL amine were added to and thoroughly mixed with the polymer. This was accomplished by the addition of about 2.0 weight percent of Standridge Color Corporation's SCC-11354 and 6.7 weight percent of SCC-8784 to the requisite amount of polypropylene. The fabric produced had a basis weight of about 2 osy. The fabric was subjected to the South Florida test described above and periodically tested for tensile strength. The data from this testing are in Table 1 and graphically illustrated in FIG. 1 where the data of this Example are divided by the initial tensile strength to arrive at a percent retention of original tensile strength and which is depicted by triangles. As shown, this fabric significantly exceeded the CMO sample (squares) in strength retention over a period in excess of 20 months. As shown in FIG. 2, the CMO (triangles in FIG. 2) represents the best results from a prior test.

EXAMPLE 4

A spunbond fabric was produced from Himont's PF-301 polypropylene. Prior to extrusion 0.75 weight percent of Chimassorb® 944 FL amine was added to and thoroughly mixed with the polymer. No pigment was added to the polymer of this Example. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by open squares.

EXAMPLE 5

A spunbond fabric was produced from Himont's PF-301 polypropylene. Prior to extrusion, 4.0 weight percent of Ferro Corporation's V-9119 and 0.75 weight percent of Chimassorb® 944 FL amine were added to and thoroughly mixed with the polymer. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by open triangles.

EXAMPLE 6

A spunbond fabric was produced from Himont's PF-301 polypropylene. Prior to extrusion, 0.5 weight percent of Ciba-Geigy Corporation's Irgazin yellow 3RLT organic pigment and 0.75 weight percent of Chimassorb® 944 FL amine were added to and thoroughly mixed with the polymer. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by circles.

EXAMPLE 7

A spunbond fabric was produced from Himont's PF-301 polypropylene. Prior to extrusion, 0.5 weight percent of Ciba-Geigy Corporation's Cromophtal yellow 3G organic pigment and 0.75 weight percent of Chimassorb® 944 FL amine were added to and thoroughly mixed with the polymer. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by asterisks.

EXAMPLE 8

A spunbond fabric was produced from Himont's PF-301 polypropylene. Prior to extrusion, 0.5 weight percent of Ciba-Geigy Corporation's phthalocyanine blue organic pigment and 0.75 weight percent of Chimassorb® 944 FL amine were added to and thoroughly mixed with the polymer. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by solid squares.

EXAMPLE 9

A spunbond fabric was produced from Himont's PF-301 polypropylene. Prior to extrusion, 0.5 weight percent of Ciba-Geigy Corporation's Cromophtal Red BR organic pigment and 0.75 weight percent of Chimassord® 944 FL amine were added to and thoroughly mixed with the polymer. The fabric produced had a basis weight of about 2 osy. The fabric was subjected to the South Florida test described above and periodically tested for tensile strength. The data from this testing are in Table 1 and graphically illustrated in FIG. 2 where the data of this Example are divided by the initial tensile strength to arrive at a percent retention of original tensile strength and which is depicted by solid triangles.

TABLE 1

| | Examples Percent Retention of Tensile Strength | | | | | | | | | | | | | | | | |
|---|---|---|---|---|---|---|---|---|---|---|---|---|---|---|---|---|---|
| Months in So. Florida | 2 | 4 | 6 | 8 | 10 | 12 | 14 | 16 | 18 | 20 | 22 | 24 | 26 | 28 | 30 | 32 | 34 |
| Example 1 | 88 | 91 | 76 | 74 | 69 | 61 | 67 | 48 | 57 | 47 | 36 | 44 | 43 | 36 | 37 | 35 | 38 |
| Example 2 | 76 | 71 | 67 | 65 | 56 | 58 | 56 | 45 | 46 | 42 | 39 | 42 | 43 | 42 | 38 | 38 | 41 |
| Example 3 | 69 | 80 | 90 | 78 | 82 | 80 | 77 | 73 | 85 | 75 | 64 | 66 | 41 | 66 | 55 | 49 | 57 |
| Example 4 | 91 | 79 | 84 | 66 | 78 | 88 | 84 | 73 | 60 | 59 | 68 | 53 | 48 | 47 | 60 | 33 | 25 |
| Example 5 | 100 | 85 | 98 | 80 | 85 | 96 | 85 | 86 | 81 | 82 | 79 | 76 | 86 | 80 | 85 | 79 | 69 |
| Example 6 | 100 | 72 | 68 | 72 | 62 | 57 | 54 | 34 | 36 | 37 | 39 | 35 | 19 | 25 | 0 | | |
| Example 7 | 84 | 54 | 37 | 37 | 20 | 17 | 0 | | | | | | | | | | |
| Example 8 | 93 | 83 | 74 | 60 | 51 | 62 | 53 | 37 | 33 | 33 | 28 | 32 | 21 | 24 | 37 | 18 | 0 |
| Example 9 | 93 | 57 | 49 | 43 | 40 | 34 | 31 | 33 | 16 | 16 | 0 | | | | | | |

It is clear from the preceding results that the stabilizer additive package of this invention (in Example 3) has a desirable and unique combination of attributes. It greatly increases the photostability of a nonwoven fabric.

It should be noted that Example 5, which had good photostability, was at an extremely high pigment loading level. Nonwovens with such high pigment loadings are quite difficult to manufacture due to problems with nozzle plugging and improper mixing. Pigment amounts over 3 weight percent are generally confined to very controlled manufacturing conditions such as in laboratories or pilot units. Further, Example 2, using the same pigment as Example 5 but at a lower loading, did not exhibit improved photostability over the unpigmented Example 1.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A nonwoven fabric comprising a polymer selected from the group consisting of polyolefins and a stabilizing additive package consisting essentially of a bismuth vanadate based pigment in an amount between about 0.1 and 3 weight percent based upon the weight of the nonwoven fabric and a hindered amine light stabilizer in an amount between about 0.1 and 3 weight percent based upon the weight of the nonwoven fabric.

2. The nonwoven fabric of claim 1 wherein said polyolefin is polypropylene.

3. The nonwoven fabric of claim 1 wherein said fabric is a first layer of a spunbond fabric.

4. The nonwoven fabric of claim 1 wherein said fabric has a basis weight between about 17 and 119 gsm.

5. The nonwoven fabric of claim 3 further comprising a second layer of spunbond fabric bonded to said first spunbond layer.

6. The nonwoven fabric of claim 5 further comprising at least one layer of meltblown fabric interposed between said first and second spunbond layers and bonded thereto.

7. The nonwoven fabric of claim 6 wherein said spunbond layers comprise a stabilizing additive package consisting essentially of a bismuth vanadate based pigment in an amount between about 0.1 and 3 weight percent based upon the weight of the spunbond layer and a hindered amine light stabilizer in an amount between about 0.1 and 3 weight percent based upon the weight of the spunbond layer.

8. The nonwoven fabric of claim 6 wherein said second layer has a basis weight between approximately 40 to 75 percent of said first layer basis weight.

9. The nonwoven fabric of claim 6 wherein said second layer is made of filaments of a lower denier than said first layer filaments.

10. A protective cover comprising the fabric of claim 6.

11. The protective cover of claim 10 wherein said protective cover is a car cover.

12. The protective cover of claim 10 wherein said protective cover is a boat cover.

13. A protective cover for vehicles comprising thermally bonded spunbond fibers of a mixture of polypropylene and a stabilizing additive package consisting essentially of bismuth vanadate in an amount between about 0.1 and 3 weight percent based upon the weight of the fabric and a hindered amine light stabilizer in an amount between about 0.25 and 2.5 weight percent based on the weight of the fabric.

* * * * *